US007448432B2

(12) United States Patent
Barker et al.

(10) Patent No.: US 7,448,432 B2
(45) **Date of Patent: *Nov. 11, 2008**

(54) SURFACE TEXTURING OF CASTING BELTS OF CONTINUOUS CASTING MACHINES

(75) Inventors: Simon William Barker, Kingston (CA); Ronald Roger Desrosiers, Kingston (CA)

(73) Assignee: Novelis Inc., Toronto, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/574,414

(22) PCT Filed: Oct. 1, 2004

(86) PCT No.: PCT/CA2004/001780

§ 371 (c)(1), (2), (4) Date: Mar. 22, 2007

(87) PCT Pub. No.: WO2005/032743

PCT Pub. Date: Apr. 14, 2005

(65) Prior Publication Data

US 2007/0193714 A1 Aug. 23, 2007

(51) Int. Cl.
*B22D 11/06* (2006.01)

(52) U.S. Cl. ..... 164/481; 164/431; 164/432

(58) Field of Classification Search ..... 164/479–482, 164/429–434

See application file for complete search history.

(56) References Cited

U.S. PATENT DOCUMENTS 3,345,738 A 10/1967 Mizikar et al.
4,061,177 A 12/1977 Silvelotti
4,061,178 A 12/1977 Silvelotti
4,250,950 A 2/1981 Buxmann et al.
4,614,224 A 9/1986 Jeffrey et al.
4,749,027 A 6/1988 Allyn et al.
4,793,400 A 12/1988 Wood (Continued)

FOREIGN PATENT DOCUMENTS

EP 0094688 A1 11/1983

(Continued)

OTHER PUBLICATIONS

European Patent Office, Supplementary European Search Report dated Feb. 27, 2007 in EP 04 78 9690.

(Continued)

*Primary Examiner*—Kuang Lin
(74) *Attorney, Agent, or Firm*—Cooper & Dunham LLP

(57) ABSTRACT

A continuous belt casting apparatus is provided with a casting cavity, and at least one flexible metal belt having an elongated casting surface passing through and at least partially defining the casting cavity. A motor is provided for rotating the metal belt in the longitudinal direction of the casting surface whereby the casting surface passes through the casting cavity in the longitudinal direction. A molten metal supply device delivers molten metal continuously to the casting cavity, so that molten metal supplied to the casting cavity is solidified and removed as a continuous strip ingot from the casting cavity by rotation of the belt. The casting surface is provided with a plurality of grooves oriented in substantially the same direction. The invention also relates to a casting belt for such an apparatus and a method of casting using the apparatus.

25 Claims, 3 Drawing Sheets

U.S. PATENT DOCUMENTS

| | | | | |
|---|---|---|---|---|
| 4,934,443 | A | 6/1990 | Honeycutt, III et al. | |
| 4,945,974 | A | 8/1990 | Honeycutt, III | |
| 5,515,908 | A | 5/1996 | Harrington | |
| 5,636,681 | A * | 6/1997 | Sulzer et al. | 164/472 |
| 6,063,215 | A | 5/2000 | Harrington | |
| 6,120,621 | A | 9/2000 | Jin et al. | |
| 6,135,199 | A | 10/2000 | Wyatt-Mair | |
| 6,470,959 | B1 | 10/2002 | Desrosiers et al. | |
| 6,581,675 | B1 * | 6/2003 | Harrington | 164/481 |
| 2002/0124990 | A1 | 9/2002 | Nikolovaki et al. | |
| 2003/0000679 | A1 | 1/2003 | Strozov et al. | |
| 2004/0045696 | A1 * | 3/2004 | Marti et al. | 164/480 |

FOREIGN PATENT DOCUMENTS

| | | | |
|---|---|---|---|
| EP | 0583867 | A1 | 2/1994 |
| EP | 0732163 | A2 | 9/1996 |
| EP | 0874703 | A1 | 11/1998 |
| EP | 0670757 | B1 | 8/1999 |
| EP | 1100638 | B1 | 4/2004 |
| FR | 1364717 | | 5/1964 |
| JP | 02-179343 | A | 7/1990 |
| JP | 63132751 | | 6/1998 |
| WO | WO 9714520 | | 4/1997 |
| WO | WO 2005/032744 | A1 | 4/2005 |

OTHER PUBLICATIONS

Field, Michael, Kahles, John F., and Koster, William P., Surface Finish and Surface Integrity, *Metals Handbook*, Ninth Edition, vol. 16, 1989, published by ASM International, Metals Park, Ohio, pp. 19-23.

Song, J.F. and Vorburger, T.V., Surface Texture, *ASM Handbook*, vol. 18, 1992, published by ASM International, Metals Park, Ohio, pp. 334-345.

* cited by examiner

SURFACE TEXTURING OF CASTING BELTS OF CONTINUOUS CASTING MACHINES

This application is a U.S. National Phase Application of PCT International Application PCT/CA2004/001780.

TECHNICAL FIELD

This invention relates to the control of heat flux in a continuous belt-casting machine used for continuously casting a molten metal in the form of a strip. More particularly, the invention relates to the surface texturing of the casting belts used in such machines.

BACKGROUND ART

Continuous casters, such as twin belt casters, single belt casters and recirculating block casters, are commonly used for producing strip ingots (continuous metal strips) from molten metals, particularly aluminum alloys. In casters of this kind, a casting cavity is formed between continuously moving casting surfaces and molten metal is introduced into the casting cavity on a continuous basis. Heat is withdrawn from the metal via the casting surfaces and the metal solidifies in the form of a strip ingot that is continuously withdrawn from the casting cavity by the moving casting surfaces. The heat flux through the casting surfaces (heat extracted from the solidifying metal) must be carefully controlled to achieve cast strip ingots of good surface quality and to avoid distortion of the casting cavity. Different metals (e.g. aluminum alloys) require different levels of heat flux for proper casting on a continuous basis, so it is important to be able to control the casting apparatus to provide the required levels of heat flux for a particular metal being cast.

The primary heat flux control is usually achieved by applying cooling water to the casting belts or blocks. In most belt casters, this is done on the back face of the belt in the region where the belt passes though the casting cavity. However, the heat flux is often adjusted more precisely by additional means. For example, belt casters have been provided with porous ceramic coatings over the metal belts. Such coatings may optionally be partially or completely filled with a high conductivity inert gas, such as helium, to provide further refinement. In such cases, the expense of maintaining a consistent ceramic coating and the cost of the inert gas have made such procedures economically unattractive.

It is also known to apply a layer of a volatile or partially volatile liquid, e.g. an oil, onto the casting surfaces before they come into contact with the molten metal. This layer is often referred to as "belt dressing" or as a "parting layer". The thickness of the layer can be varied to provide for control of heat flux to the underlying casting surfaces. However, the use of such oils may adversely affect the surface quality of the cast strip ingot (particularly ingots made from aluminum alloys containing high levels of magnesium), and may give rise to environmental issues, particularly when excessive applications are required in order to achieve the desired degree of heat flux control.

U.S. Pat. No. 4,614,224 issued on Sep. 30, 1980 to Paul W. Jeffery et al. and U.S. Pat. No. 6,120,621 issued on Sep. 19, 2000 to Iljoon Jin et al. disclose the use of randomly textured steel belts (textured by means of shot blasting), in which a layer of liquid is applied to the belt surface prior to contacting the surface with the molten metal. The belt surface is cooled by direct application of coolant to the reverse side of the belt as it passes though the casting cavity. The liquid is generally a hydrocarbon which at least partially volatilizes in use and forms a gaseous layer between the molten metal and the belt surface. This gaseous layer has insulating properties and therefore creates a significant temperature drop between the molten metal and the belt surface. The residual liquid itself has relatively little effect. By varying the amount of liquid applied, it is possible to modulate the effect of the gaseous layer and achieve a certain control over the heat flux through the metal belt, and enhance the casting process. These two patents teach a surface roughness of 210 micro-inches (5.3 micrometers) (RMS) and 160 to 512 micro-inches (4 to 13 micrometers) ($R_a$), respectively.

In casters such as described above where coolant is applied directly to the reverse side of the belt as it passes through the casting cavity, an increased heat flux can be achieved through use of belts of higher conductivity (such as copper), and by reducing the amount of liquid parting layer. Conventional texturing as applied to such high conductivity belts reduces the maximum high heat flux capability, yet elimination of such texturing can lead to problems of meniscus stability during casting.

U.S. Pat. No. 6,063,215 issued on May 16, 2000 to Donald G. Harrington discloses a steel casting belt which is textured in a more regular manner, i.e. it teaches transverse grooves or dimples provided on a steel casting surface. This textured steel belt is then artificially oxidized. The texturing is said to promote a more uniform heat transfer and allow for escape of gases that may form during casting. Such belts are used in casters where the belt is cooled in a area remote from the casting cavity, and does not use a parting agent.

U.S. Pat. No. 6,135,199 issued on 24 Oct. 2000 to Gavin Wyatt discloses a belt caster where the belts may have fine longitudinal grooves, but refers to U.S. application Ser. No. 08/543,445 (which issued by continuation as U.S. Pat. No. 6,063,215) as being the preferred embodiment.

Therefore, there is a need to provide an improved casting belt having a the high heat removal capability characteristic of a casting belt directly cooled by coolant on its reverse face, while providing for a stable casting process with no distortion in the belt.

DISCLOSURE OF THE INVENTION

According to one aspect of the invention, there is provided a continuous belt casting apparatus, comprising a casting cavity, at least one (preferably two) flexible metal belt having an elongated casting surface passing through and at least partially defining the casting cavity, a motor for rotating said at least one metal belt in a longitudinal direction of said casting surface whereby said casting surface passes through said casting cavity in said longitudinal direction, and a molten metal supply device adapted to deliver molten metal continuously to the casting cavity, whereby molten metal supplied to the casting cavity is solidified and removed as a continuous strip ingot from said casting cavity by rotation of said at least one belt, wherein said casting surface is provided with a plurality of grooves oriented in substantially the same direction. The grooves preferably impart a surface roughness ($R_a$) to the casting surface in the range of 18 to 80 micro-inches (0.46 to 2.0 micrometers), more preferably 18 to 65 micro-inches (0.46 to 1.65 micrometers), and most preferably 25 to 45 micro-inches (0.64 to 1.14 micrometers), the roughness being measured perpendicular to the direction of the grooves. The relative spacing of the grooves is such that the roughness average ($R_a$) is measured over distances of less than 10 mm, more typically about 5 mm, taken perpendicular to the direction of the grooves. Advantageously, the casting belt is made of copper or a copper alloy, or aluminum or an aluminum alloy.

The apparatus preferably includes a supply device adapted to supply an at least partially volatile liquid parting agent to said casting surface before said casting surface contacts molten metal in the casting cavity.

The apparatus also preferably includes a removal device adapted to remove said parting agent from said casting surface after said casting surface exits said casting cavity and separates from said continuous strip ingot.

It is also particularly preferred that the apparatus be a belt caster having coolant outlets provided to apply to the reverse side of the belt as it passed through the casting cavity.

According to another aspect of the invention, there is provided a method of casting metal to form a continuous strip ingot, which comprises forming a casting cavity by providing at least one flexible metal band having an elongated casting surface with the casting surface passing through and at least partially defining the casting cavity, continuously supplying molten metal to the casting cavity and rotating the band in a longitudinal direction of the casting surface to draw said molten metal through the casting cavity and to remove from the cavity a solidified strip ingot formed as said molten metal solidifies in the casting cavity, wherein said casting surface is provided with a plurality of grooves oriented in substantially the same direction.

According to yet another aspect of the invention, there is provided a casting belt adapted for use in a continuous belt caster, said casting belt comprising a flexible metal belt having an elongated casting surface provided with a plurality of grooves oriented in substantially the same direction In the present invention, the grooves are preferably oriented in a direction less than 45 degrees (more preferably less than 20 degrees, and ideally less than 10 degrees or even less than 5 degrees) from the longitudinal direction of the belt, and most preferably are oriented substantially in the longitudinal direction of the belt. Preferably, the entire casting surface of the belt(s) is provided with the grooves and the grooves are substantially contiguous cross-wise of the belt so that, if they are separated by flat ungrooved lands, such lands have a width less than the width of the adjacent grooves.

A further understanding, aspects and advantages of the present invention will be realized by reference to the following description, appended claims and accompanying drawings.

BRIEF DESCRIPTION OF THE DRAWINGS

The invention is described in more detail below with reference to the accompanying drawings, in which.

BEST MODES FOR CARRYING OUT THE INVENTION

Figure 1:
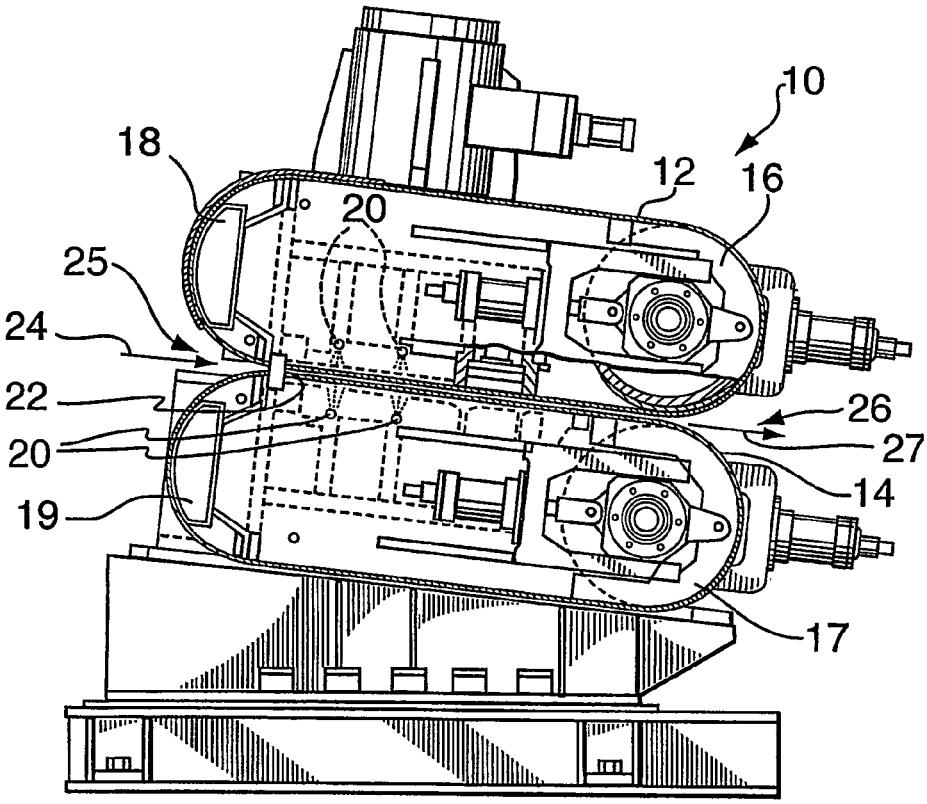
FIG. 1 is a simplified side view of a continuous twin-belt casting machine which can be used in the present invention.
Figure 2:
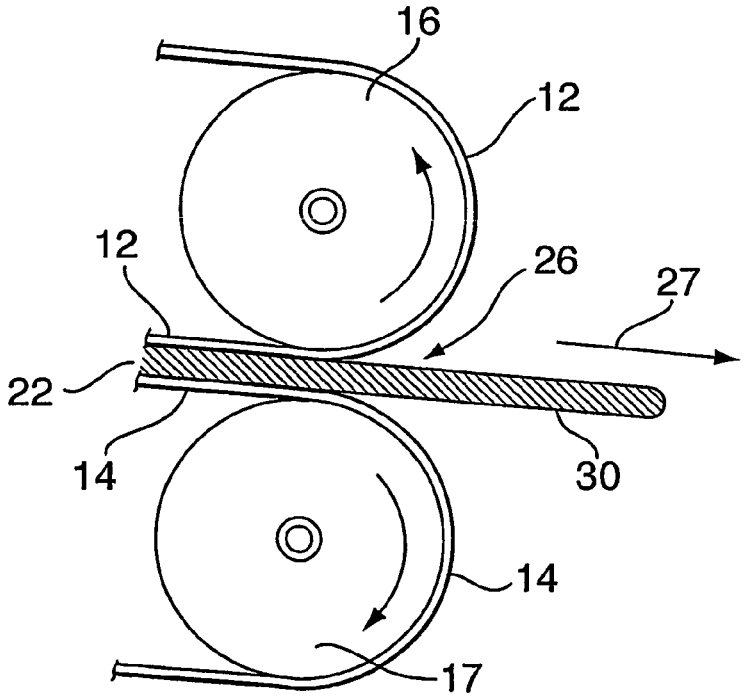
FIG. 2 is an enlarged view of the exit portion of the casting machine in FIG. 1.

FIGS. 1 and 2 show a twin-belt casting machine 10 for continuous-casting a molten metal such as aluminum alloy melt in the form of a strip ingot. The present invention may apply, but by no means exclusively, to the casting belts of this type of casting machines, which are disclosed, for example, in U.S. Pat. Nos. 4,061,177 and U.S. Pat. No. 4,061,178, the disclosures of which are incorporated herein by reference. It is noted that the principles of the present invention can be successfully applied to the casting belt of a single belt casting system. The structure and operation of the continuous belt casting machine of FIGS. 1 and 2 are briefly explained below.

As shown in FIGS. 1 and 2, the casting machine 10 includes a pair of resiliently flexible, casting belts 12 and 14, each of which is carried by an upper pulley 16 and lower pulley 17 at one end and an upper liquid bearing 18 and lower liquid bearing 19 at the other end. Each pulley is rotatably mounted on a supporting structure of the machine and is driven by suitable driving means. For the purpose of simplicity, the supporting structure and the driving means are not illustrated in FIGS. 1 and 2. The casting belts 12 and 14 are arranged to run substantially parallel to each other at substantially the same speed through a region in which they define a casting cavity 22 (also, referred to as a "molding gap" or a "moving mold") therebetween, i.e. between casting surfaces of the belts. The casting cavity 22 can be adjusted in width by means of edge dams (not shown), depending on the desired thickness of the aluminum strip being cast. The pair of belts run substantially parallel to each other in the casting cavity, preferably with some degree of convergence. A molten metal is continuously supplied into the casting cavity 22 in the direction of the arrow 24 via entrance 25 while the belts are chilled, in the region of the casting cavity, at their reverse faces, for example, by direct impingement of coolant liquid 20 on the reverse surfaces. The cast strip then emerges from exit 26 in the direction of arrow 27.

In the illustrated apparatus, the path of the molten metal being cast is substantially horizontal with a small degree of downward slope from entrance 25 to exit 26 of the casting cavity.

Molten metal is supplied to the casting cavity 22 by a suitable launder or trough (not shown) which is disposed at the entrance 25 of the casting cavity 22. For example, the molten metal injector described in U.S. Pat. No. 5,636,681, which is assigned to the same assignee as the present application, may be used for supplying molten metal to the casting machine 10. Although not shown, an edge dam is provided at each side of the machine so as to complete the enclosure of the casting cavity 22 at its edges. It will be understood that in the operation of the casting machine, the molten metal supplied to the entrance 25 of the casting cavity 22 advances through the casting cavity 22 to the exit 26 thereof by means of continuous motion of the belts 12, 14. During the travel along the casting cavity (moving mold) 22, heat from the metal is transferred through the belts 12, 14 and removed therefrom by the supplied coolant 20, and thus the molten metal becomes progressively solidified from its upper and lower faces inward in contact with the casting surfaces of the belts. The molten metal is fully solidified before reaching the exit 26 of the casting cavity and emerges from the exit 26 in the form of a continuous, solid, cast strip 30, the thickness of which is determined by means of the width of the casting cavity 22 as defined by the casting surfaces of the belts 12 and 14. The width of the cast strip 30 is defined by side dams (not shown) that are located near the edges of the casting belts 12, 14.

The belts themselves are constructed in an appropriate manner for a casting machine of this type, being advantageously of metal of appropriately high strength and of such a nature that they can be sufficiently tensioned without plastic yield. Although, for use in the present invention, the belts can be made of steel or any other material that is conventionally used for belts of this kind, high conductivity metals are preferred for the present invention, e.g. appropriate copper alloys. Even aluminum alloys having the required properties may be used as disclosed in co-pending U.S. application Ser. No. 60/508,388 filed Oct. 3, 2003 in the names of Willard M. T. Gallerneault et al., and assigned to the same assignee as the present application, the disclosure of which is incorporated herein by reference.

In accordance with the present invention, one or preferably both casting belts are provided with a texture on the surface thereof in order to modulate the heat flux from the molten metal and to stabilize the points of contact between the molten metal and the casting belt (i.e. the metal meniscus), thereby avoiding casting defects in the resultant metal strip and also eliminating or reducing thermal distortion due to the thermal stress imposed on the belt. In the present invention, the casting surface of the belt is textured by creating multiple elongated grooves oriented in substantially the same direction, preferably the moving direction of the casting belts, i,e. in substantially the longitudinal direction of the belts. In other words, the major directional component of each groove preferably runs along the moving or longitudinal direction of the casting belt. The provision of such grooves can be achieved, for example, by grinding the belt surface with a grinding medium, e.g. a grinding paper or fabric, using a grinding machine, such as a belt sander or grinder, operating in the longitudinal direction of the belt. The grinding medium is chosen to produce the desired average surface roughness, i.e. within the range of 18 to 80 micro-inches (0.46 to 2.0 micrometers).

Figure 3:
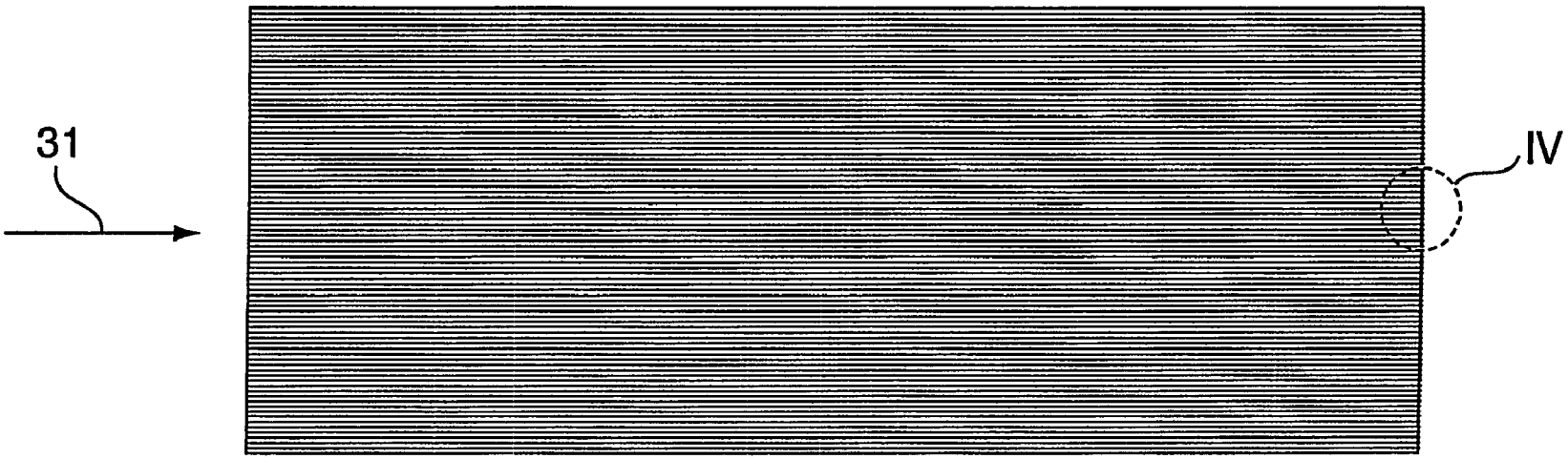
FIG. 3 is a graphical representation of the surface of a casting belt in accordance with the present invention.
Figure 4:
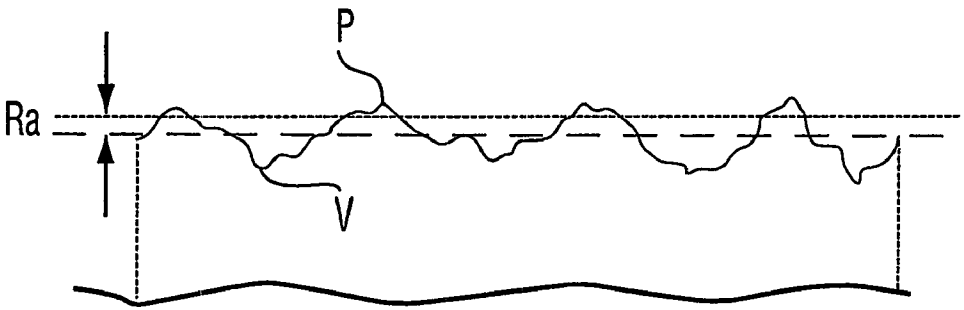
FIG. 4 is an enlarged partial cross-section of the belt of FIG. 3, i.e. taken from a region IV of FIG. 3.

FIG. 3 is a representation of the casting surface of a casting belt showing, in exaggerated form, a surface texture in accordance with a preferred form of the present invention, i.e., surface grooves provided in the casting surface of the belts. The casting direction (direction of movement of the belt) is shown by arrow 31. In the preferred embodiment of FIG. 3, the grooves provide to the casting surface a roughness in a range of 18-80 micro-inches (0.46 to 2.0 micrometers), preferably 18-65 micro-inches (0.46 to 1.65 micrometers), more preferably 25-45 micro-inches (0.64 to 1.14 micrometers), in units of conventional average surface roughness ($R_a$). The surface roughness value ($R_a$) is the arithmetic mean surface roughness. This measurement of roughness is described, for example, in an article by Michael Field, et al., published in the Metals Handbook, Ninth Edition, Volume 16, 1989, published by ASM International, Metals Park, Ohio 44073, USA, pages 19 to 23; the disclosure of which is incorporated herein by reference. FIG. 4 is a cross-section of a part of the surface illustrated in FIG. 3 (transverse to the casting direction 31), showing the roughness arithmetic average ($R_a$) of the peaks P and valleys V of the surface. There are several ways of measuring surface roughness that are well known to persons skilled in the art.

It has been found that, if the roughness ($R_a$) of the belt is less than about 18 micro-inches (0.46 micrometers), the meniscus becomes unstable resulting in surface defects, and the interior of cast strip suffers from porosity and other casting defects. If the roughness of the belt exceeds 80 micro-inches, the surface of the cast strip has exposed dendrites (referred to as "frost") or exudates (referred to as "blebs"), although the interior of the slab may be sound. The upper limit is somewhat alloy-dependent and therefore a particularly preferred upper limit of 80 micro-inches may be used to cover the broadest range of alloys. However, it has been found that the roughness of 18 to 65 micro-inches is more preferable, and the roughness of 25-45 micro-inches is even more preferable, as shown the examples which is hereafter described in detail.

The grooves provided in the casting surface of the belt can work more effectively in cooperation with a liquid parting layer applied to the casting surface prior to contacting the molten metal. The liquid parting agent constituting the parting layer is preferably one that is at least partially volatile when in use. The grooves of the present invention allow the volatized parting layer to be more effectively distributed within the casting cavity (in the direction of casting) than is the case if the grooves are random, which improves the heat distribution. This is particularly the case in the preferred embodiments where the grooves are oriented closer to the longitudinal direction of the belt. The preferred embodiments also provide the casting belt with the required number of surface asperities in the casting direction, thereby stabilizing meniscus behavior and allowing higher casting speeds to be attained.

Known belt texturing systems used with liquid parting agents tend to use heavy texturing, e.g. shot-blast dimples as disclosed for example in U.S. Pat. No. 6,120,621 having a texture in the range 160 to 512 micro-inches, which require the application of substantial amounts of parting agent. The grooves in accordance with the present invention require less parting agent, but achieve a distribution of such parting agent that permits high heat fluxes to be sustained in casting systems where coolant is applied directly to the reverse side of the belts, but without belt distortion due to unstable non-uniform thermal stress.

Furthermore, the invention operates more effectively when the residual parting agent (layer) is substantially completely removed from the casting surface after its emergence from the casting cavity, and application of a new parting layer thereto before reentry into the casting cavity and contact with the molten metal being continuously supplied.

Figure 5:
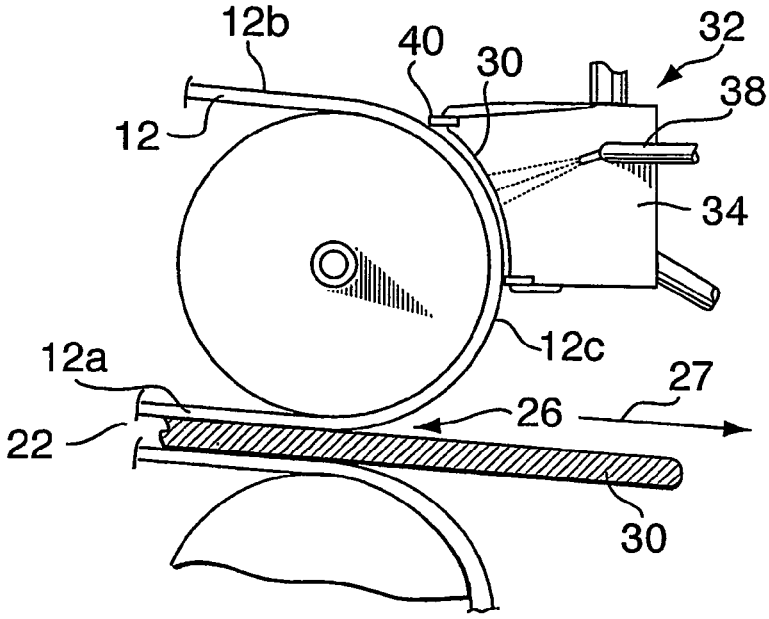
FIG. 5 shows a simplified cross-section of a parting layer removal device which can be used for removing residual parting agent from a casting surface.
Figure 6:
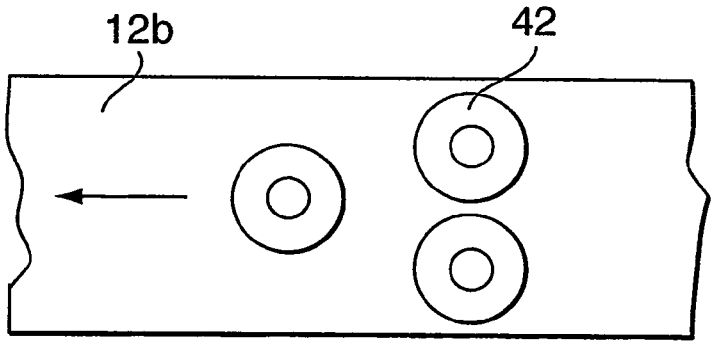
FIG. 6 schematically illustrates a device for applying a new layer of parting agent to a casting surface.
Figure 7:
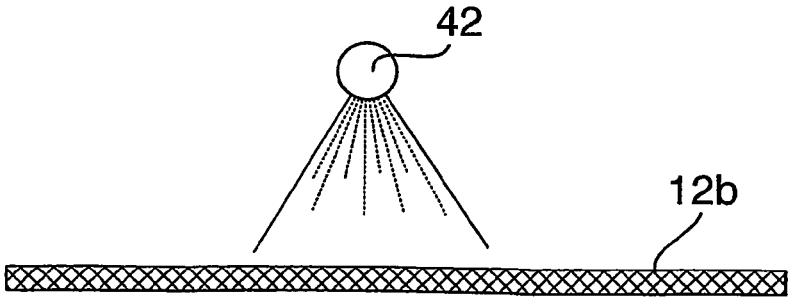
FIG. 7 is a simplified longitudinal vertical cross-section of FIG. 6.

For this purpose, devices shown in FIGS. 5, 6 and 7 can be used, which are disclosed in U.S. Pat. No. 5,636,681 issued on Jun. 10, 1997 to John Sulzer et al. and assigned to the same assignee as the present application. The disclosure of this patent is incorporated herein by reference. The structure and operation of these devices are briefly explained below. FIG. 5 shows a simplified cross-section of part of a belt casting machine showing parting layer removal device 32. FIG. 6 schematically illustrates a device for applying a new layer of parting agent to a casting surface, and FIG. 7 is a simplified longitudinal vertical cross-section of FIG. 6.

In FIG. 5, there is shown a part of an upper belt 12 at the exit end of the casting cavity of the twin-belt casting machine 10 (FIG. 1). The molten metal solidifies as a strip 30 in contact with casting surface 12*a* moving in the direction of arrow 27. A portion 12*c* of the belt 12 is newly released from contact with the solidified metal strip and has a surface coating of a parting agent contaminated with detritus following contact with the hot metal. A new layer of liquid parting agent is applied to the return surface 12*b* of the belt at a station (not shown in FIG. 5, but see FIGS. 6 and 7) upstream of the injector for applying the molten metal layer.

The parting layer removal device 32 is positioned adjacent to the belt 12 for the purpose of completely removing the old parting agent and detritus from the surface of the belt before the fresh new parting agent is applied. The removal device 32 consists of a hollow casing 34 extending across the width of the belt and closed on all sides except at an open side 36 facing an adjacent surface of the belt 12. A spray bar 38 with flat spray nozzles is positioned within the casing 34 and directs a high pressure spray of a cleaning liquid. The spray of cleaning liquid removes most of the parting liquid and contaminating detritus from the surface of the belt as the belt moves past the removal device 32. Any residual cleaning liquid or detritus on the belt surface is removed by a scraper 40.

The removal device 32 makes it possible to remove a contaminated layer of parting liquid and solid detritus from the belt surface quickly, efficiently and continuously so that the casting surface of the belt 12 emerging from the casting cavity 22 is completely clean and ready for the application of a fresh new layer of parting liquid before receiving molten metal once again.

For more effective operation of the grooves of the invention, a new parting liquid layer is applied thinly and uniformly across the width of the belt after the removal of residual parting agent previously applied. FIGS. 6 and 7, there are shown non-contacting electrostatic spray devices 42 which can be used for applying a new parting layer. The amount of parting liquid may be varied by changing the liquid flow rate delivered to the spray heads.

By arranging electrostatic spray devices along the belt in overlapping echelon as shown in FIG. 6, a uniform application of the parting liquid across the width of the belt can be achieved. The actual distribution of the liquid can be measured in preliminary runs using small metal tokens attached across the belt. Removal and precise weighing of the tokens reveals the spray distribution so that the spray devices can be adjusted for uniform spraying, if necessary.

The invention is illustrated further with reference to the Examples below, which is not intended to limit the scope of the present invention.

EXAMPLE

A series of castings of aluminum alloy (type AA5754) were performed using a twin-belt casting machine. A copper belt having a thickness of 1.5 mm was used. The copper belts were textured with grooves parallel to the casting direction using an abrasive band and the texture (roughness) was varied to different roughness values. The roughness was quantified using the roughness average (Ra) measured across the predominant lay of the grind. Two textures were placed on any particular belt. Different grades of grinding belt were used to prepare the belts: A16 through A80, where the number refers to the roughness value (Ra) in micro-inches that is obtained when using these grinding papers. The roughness of the freshly prepared grooved belt surface was obtained using a portable profilometer (5.60 mm evaluation length with a 0.8 mm cut-off), as well as from replicas taken of the freshly prepared belt surface. Casting was performed at different casting speeds and under different heat flux conditions.

Cast slab surface quality was determined from the surface appearance; a number rating system (1 through 5) was developed with the better quality being attributed a low number. It was determined that the best slab surface quality was obtained when using belts prepared with measured $R_a$ roughness values in the range of 25 to 45 micro-inches (0.46 to 1.14 micrometers). Under certain casting conditions, this range may be extended to a range of 18 to 80 micro-inches (0.46 to 2.0 micrometers). Table 1 gives the average roughness value ($R_a$) and the resulting assessment of the overall effect on the cast strip.

TABLE 1

Cast quality depending on surface roughness values

| Roughness (Ra) in micro-inches | Cast quality | Remarks |
|---|---|---|
| 16 | Surface defects resulting from meniscus instability and internal porosity | Unacceptable |
| 25 | Good quality surface and good interior | Good |
| 45 | Generally good quality surface and good interior | Good |
| 65 | some surface "frost", good interior | Acceptable |
| 80 | Extensive surface "frost" or "blebs", interior good | Unacceptable |

While the present invention has been described with reference to several preferred embodiments, the description is illustrative of the invention and is not be construed as limiting the invention. Various modifications and variations may occur to those skilled in the art, without departing from the true spirits and scope of the invention as defined by the appended claims.

The invention claimed is:

1. A continuous belt casting apparatus, comprising a casting cavity, at least one flexible metal belt having an elongated casting surface passing through and at least partially defining the casting cavity, a motor for rotating said at least one metal belt in a longitudinal direction of said casting surface whereby said casting surface passes through said casting cavity in said longitudinal direction, and a molten metal supply device adapted to deliver molten metal continuously to the casting cavity, whereby molten metal supplied to the casting cavity is solidified and removed as a continuous strip ingot from said casting cavity by rotation of said at least one belt, wherein said casting surface is made of said metal and is provided with a plurality of grooves oriented in substantially the same direction, and wherein said plurality of grooves impart a surface roughness (Ra) to the casting surface, said surface roughness ($R_a$) being in the range of 18 to 80 micro-inches (0.46 to 2.0 micrometers).

2. The apparatus of claim 1, wherein the roughness (Ra) of the casting surface is in a range of 18 to 65 micro-inches (0.46 to 1.65 micrometers).

3. The apparatus of claim 1, wherein the roughness (Ra) of the casting surface is in a range of 25 to 45 micro-inches (0.64 to 1.14 micrometers).

4. The apparatus of claim 1, wherein said at least one casting belt is made of copper or a copper alloy.

5. The apparatus of claim 1, wherein said at least one casting belt is made of aluminum or an aluminum alloy.

6. The apparatus of claim 1, wherein the casting belt is made of steel.

7. The apparatus of claim 1, wherein the grooves are oriented in a direction within 45 degrees of the longitudinal direction of the casting surface.

8. The apparatus of claim 1, wherein the grooves are oriented substantially in the longitudinal direction of the casting surface.

9. The apparatus of claim 1, being a twin belt caster provided with two belts.

10. The apparatus of claim 1, including a supply device adapted to supply an at least partially volatile liquid parting agent to said casting surface before said casting surface contacts molten metal in the casting cavity.

11. The apparatus of claim 9, further including a removal device adapted to remove said parting agent from said casting surface after said casting surface exits said casting cavity and separates from said continuous strip ingot.

12. The apparatus of claim 1, including means for applying coolant to the reverse side of said metal belt as it passes through the said casting cavity.

13. A method of casting metal to form a continuous strip ingot, which comprises forming a casting cavity by providing at least one flexible metal belt having an elongated casting surface with the casting surface passing through and at least partially defining the casting cavity, continuously supplying molten metal to the casting cavity and rotating the belt in a longitudinal direction of the casting surface to draw said molten metal through the casting cavity and to remove from the cavity a solidified strip ingot formed as said molten metal solidifies in the casting cavity, wherein said casting surface is made of said metal and is provided with a plurality of grooves oriented substantially in the same direction, and wherein said plurality of grooves impart a surface roughness ($R_a$) to the casting surface, said surface roughness ($R_a$) being in the range of 18 to 80 micro-inches (0.46 to 2.0 micrometers).

14. The method of claim 13, wherein the casting surface is provided with grooves that impart a surface roughness (Ra) to the casting surface in a range of 18 to 65 micro-inches (0.46 to 1.65 micrometers).

15. The method of claim 13 wherein the casting surface is provided with grooves that impart a surface roughness (Ra) to the casting surface in a range of 25 to 45 micro-inches (0.64 to 1.14 micrometers).

16. The method of claim 13, which comprises providing said at least one casting belt made of copper or a copper alloy.

17. The method of claim 13, which comprises providing said at least one casting belt made of aluminum or an aluminum alloy.

18. The method of claim 13, which comprises providing said at least one casting belt made of steel.

19. The method of claim 13, which comprises employing as said casting surface a surface on which said plurality of grooves is oriented in a direction within 45 degrees of the longitudinal direction of the casting surface.

20. The method of claim 13, which comprises employing as said casting surface a surface on which said plurality of grooves is oriented substantially in the longitudinal direction of the casting surface.

21. The method of claim 13, which comprises providing two belts to define said casting cavity.

22. The method of claim 13, which comprises supplying molten aluminum or aluminum alloy to said casting cavity as said molten metal.

23. The method of claim 13, which further comprises supplying an at least partially volatile liquid parting agent to said casting surface before contacting said casting surface with said molten metal.

24. The method of claim 13, which further comprises removing said parting agent from said casting surface after said casting surface exits said casting cavity and separates from said continuous strip ingot.

25. The method of claim 13, which further comprises applying coolant to a reverse side of said belt as it passes through said casting cavity.

* * * * *